US008805225B2

(12) United States Patent
Waida et al.

(10) Patent No.: US 8,805,225 B2
(45) Date of Patent: Aug. 12, 2014

(54) FIXING DEVICE AND IMAGE FORMING APPARATUS

(71) Applicants: Takumi Waida, Tokyo (JP); Ryota Yamashina, Kanagawa (JP); Kazuya Saito, Kanagawa (JP)

(72) Inventors: Takumi Waida, Tokyo (JP); Ryota Yamashina, Kanagawa (JP); Kazuya Saito, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 21 days.

(21) Appl. No.: 13/749,164

(22) Filed: Jan. 24, 2013

(65) Prior Publication Data

US 2013/0202322 A1 Aug. 8, 2013

(30) Foreign Application Priority Data

Jan. 27, 2012 (JP) ..... 2012-015302

(51) Int. Cl.
*G03G 15/20* (2006.01)

(52) U.S. Cl.
USPC ..... 399/68; 399/328; 399/88

(58) Field of Classification Search
USPC ..... 399/68–69, 337
See application file for complete search history.

(56) References Cited

U.S. PATENT DOCUMENTS

| | | | | |
|---|---|---|---|---|
| 4,782,362 | A * | 11/1988 | Mitsuya et al. | 399/337 |
| 5,942,882 | A * | 8/1999 | Ohta | 323/282 |
| 6,927,368 | B2 * | 8/2005 | Cao et al. | 219/492 |
| 2004/0184848 | A1 | 9/2004 | Oonishi | |
| 2006/0002745 | A1 | 1/2006 | Iwasaki | |
| 2007/0292175 | A1 | 12/2007 | Shinshi | |
| 2009/0297199 | A1 | 12/2009 | Yamashina et al. | |
| 2010/0014903 | A1 | 1/2010 | Seto et al. | |
| 2010/0061754 | A1 | 3/2010 | Ishigaya et al. | |
| 2010/0092220 | A1 | 4/2010 | Hasegawa et al. | |
| 2010/0092221 | A1 | 4/2010 | Shinshi et al. | |
| 2010/0232844 | A1 | 9/2010 | Saito et al. | |

(Continued)

FOREIGN PATENT DOCUMENTS

| | | |
|---|---|---|
| JP | 08-095422 | 4/1996 |
| JP | 2861280 | 12/1998 |

(Continued)

OTHER PUBLICATIONS

U.S. Appl. No. 13/716,651, filed Dec. 17, 2012, Saito.

(Continued)

*Primary Examiner* — Clayton E Laballe
*Assistant Examiner* — Leon W Rhodes, Jr.
(74) *Attorney, Agent, or Firm* — Oblon, Spivak, McClelland, Maier & Neustadt, L.L.P.

(57) ABSTRACT

A fixing device includes a rotatable fixing member that heats a surface of a recording medium on which an unfixed image is carried, a rotatable pressing member that makes pressure-contact with the fixing member to form a nip portion therebetween, a heat source that heats the fixing member, a temperature detecting unit that detects a temperature of the fixing member, and a temperature control unit that controls turning-on/off the heat source in accordance with a predetermined duty for a predetermined control cycle in a turning-on/off cycle, based on input temperature information. The temperature control unit, during execution of a continuous image-forming job for continuously forming images on a plurality of recording media, sets the control cycle and a space between the recording media to be conveyed to the nip so that a number of turn-ons of the heat source is the same for all the recording media.

9 Claims, 6 Drawing Sheets

(56) References Cited

U.S. PATENT DOCUMENTS

| | | | |
|---|---|---|---|
| 2010/0239292 | A1 | 9/2010 | Fujita et al. |
| 2011/0052224 | A1 | 3/2011 | Yamashina et al. |
| 2011/0064437 | A1 | 3/2011 | Yamashina et al. |
| 2011/0091226 | A1 | 4/2011 | Ishigaya et al. |
| 2011/0182634 | A1 | 7/2011 | Ishigaya et al. |
| 2011/0206402 | A1 | 8/2011 | Yamashina |
| 2011/0217057 | A1 | 9/2011 | Yoshinaga et al. |
| 2011/0222927 | A1 | 9/2011 | Yamashina |
| 2011/0229180 | A1 | 9/2011 | Saito |
| 2012/0045226 | A1 | 2/2012 | Hase et al. |
| 2012/0051766 | A1 | 3/2012 | Ueno et al. |
| 2012/0093531 | A1 | 4/2012 | Yuasa et al. |
| 2012/0093532 | A1 | 4/2012 | Ishigaya et al. |
| 2012/0093534 | A1 | 4/2012 | Waida et al. |
| 2012/0093551 | A1 | 4/2012 | Ogawa et al. |
| 2012/0107005 | A1 | 5/2012 | Hase et al. |
| 2012/0114354 | A1 | 5/2012 | Saito et al. |
| 2012/0177424 | A1 | 7/2012 | Saito et al. |
| 2012/0201547 | A1 | 8/2012 | Yamashina |
| 2012/0207523 | A1 | 8/2012 | Ueno et al. |
| 2012/0219312 | A1 | 8/2012 | Yuasa et al. |
| 2012/0243895 | A1 | 9/2012 | Samei et al. |

FOREIGN PATENT DOCUMENTS

| | | | | |
|---|---|---|---|---|
| JP | 11-133791 | | | 5/1999 |
| JP | 2002-049264 | | | 2/2002 |
| JP | 2004-286922 | | | 10/2004 |
| JP | 2006-047990 | | | 2/2006 |
| JP | 2007003992 | A | * | 1/2007 |
| JP | 2007139916 | A | * | 6/2007 |
| JP | 2007-233011 | | | 9/2007 |
| JP | 2007-241155 | | | 9/2007 |
| JP | 2007-334205 | | | 12/2007 |
| JP | 2010-072124 | | | 4/2010 |
| JP | 2010-217205 | | | 9/2010 |
| JP | 2011-158558 | | | 8/2011 |

OTHER PUBLICATIONS

U.S. Appl. No. 13/755,439, filed Jan. 31, 2013, Seo, et al.
U.S. Appl. No. 13/761,848, filed Feb. 7, 2013, Waida, et al.
U.S. Appl. No. 13/753,827, filed Jan. 30, 2013, Yamashina, et al.

* cited by examiner

FIXING DEVICE AND IMAGE FORMING APPARATUS

CROSS-REFERENCE TO RELATED APPLICATIONS

The present application claims priority to and incorporates by reference the entire contents of Japanese Patent Application No. 2012-015302 filed in Japan on Jan. 27, 2012.

BACKGROUND OF THE INVENTION

1. Field of the Invention

The present invention relates to a fixing device which fixes an image onto a recording medium, and relates also to an image forming apparatus including the fixing device.

2. Description of the Related Art

In recent years, marketing needs are increasing for energy saving purposes and high-speed performance in an image forming apparatus, such as a printer, a copier, and a facsimile. In the image forming apparatus, an unfixed toner image is formed on a recording medium, such as a recording medium sheet, a printing sheet of paper, a photosensitive sheet of paper, an electrostatic recording sheet of paper. At this time, the image formation is performed using an image transfer method or a direct method, through an image forming process, including electrophotographic recording, electrostatic recording, or magnetic recording. As a fixing device for fixing an unfixed toner image, the widely applied system is a fixing device of a contact heating system, for example, a heat roller system, a film heating system, and an electromagnetic induction heating system.

An example of this fixing device is a known fixing device with a so-called belt system (for example, see Japanese Patent Application Laid-open No. 2010-72124 and Japanese Patent Application Laid-open No. 2004-286922).

In recent years, there is a demand on energy saving performance, and there is also a demand on foreshortening of a warm-up time and a fast printing time. Note that the warm-up time indicates the time of power activation, for example, the time required for a predetermined temperature (reload temperature) from a normal temperature, while the fast printing time indicates a period of time since reception of a print request until complete discharge of the printed sheet of paper after a printing operation via print preparation. To meet these demands, low heat capacity is attempted using a fixing member which is formed of a thin wall roller or an endless-loop belt member (including a film-like form) with a flexible thin wall. Also, high speed heating is realized using a heat source, such as a halogen heater or a graphite heater, which heats the fixing member with radiant heat, a ceramic heater, and an IH system with high heating efficiency. The heating method may be a heating method for indirectly heating the fixing member through a metal conductor using a heat source (for example, see Japanese Patent Application Laid-open No. 2007-334205) or a heating method for directly heating the fixing member using a heat source (for example, see Japanese Patent Application Laid-open No. 2002-49264, Japanese Patent Application Laid-open No. 2010-217205, Japanese Patent Application Laid-open No. 2007-233011, Japanese Patent No. 2861280, and Japanese Patent Application Laid-open No. 2011-158558). As the method for directly heating the fixing member using a heat source, an applicable method may be a method for heating an area of a nip of the fixing member using a heat source (see Japanese Patent No. 2861280 and Japanese Patent Application Laid-open No. 2011-158558) or a method for heating an area other than the nip of the fixing member using a heat source (see Japanese Patent Application Laid-open No. 2002-49264, Japanese Patent Application Laid-open No. 2010-217205, and Japanese Patent Application Laid-open No. 2007-233011).

In this type of fixing device, to secure the stable fixity maintained at a target temperature (fixing temperature) of the fixing member, a temperature-detecting unit detects the temperature of the fixing member based on temperature information from the temperature-detecting unit, and turning-on/off of the heat source is controlled. For example, in Japanese Patent Application Laid-open No. 2010-72124, the temperature information from the temperature-detecting unit for detecting the temperature of the fixing belt is input to a temperature controller (PID controller), and the temperature controller obtains a duty based on a difference between the temperature detected by the temperature-detecting unit and the target temperature. This duty is also called a duty ratio, and is a ratio W/C of a turn-on time period W per unit time (per control cycle C) in the turn-on/off cycle of a heat source). The controller controls the turning-on/off of the heat source through a PMM driving circuit, based on the obtained duty. As a result, the heat source repeats operating/stopping in accordance with the duty. When the heat source is a halogen heater, the halogen heater repeats the turning-on/off in accordance with the duty.

As described above, in the conventional fixing device, the turning-on/off of the heat source is controlled in accordance with a duty for a predetermined control cycle, based on the temperature information from the temperature-detecting unit which detects the temperature of the fixing belt. By doing this, the temperature of the fixing member is kept at a target temperature (fixing temperature), to attain the stable fixity. However, in the fixed image on the sheet of paper, the gloss value varies, and image irregularities occur in accordance with the progress of the continuous image-forming job, in the continuous image-forming job for continuously forming images on a plurality of recording media, thus lowering quality of toner fixing.

Therefore, there is a need for a fixing device and an image forming apparatus capable of preventing lowering of fixing quality in a continuous image-forming job.

SUMMARY OF THE INVENTION

According to an embodiment, there is provided a fixing device that includes a fixing member that is rotatable and heats a surface of a recording medium on which an unfixed image is carried; a pressing member that is rotatable and makes pressure-contact with the fixing member to form a nip portion therebetween; a heat source that heats the fixing member; a temperature detecting unit that detects a temperature of the fixing member; and a temperature control unit that controls turning-on/off of the heat source in accordance with a predetermined duty for a predetermined control cycle in a turning-on/off cycle, based on temperature information input from the temperature detecting unit. The temperature control unit is configured to, during execution of a continuous image-forming job for continuously forming images on a plurality of recording media, set the control cycle and a space between the recording media to be conveyed to the nip in such a manner that a number of turn-ons of the heat source is the same for all the recording media.

According to another embodiment, there is provided an image forming apparatus including the fixing device described above.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENT

Figure 1:
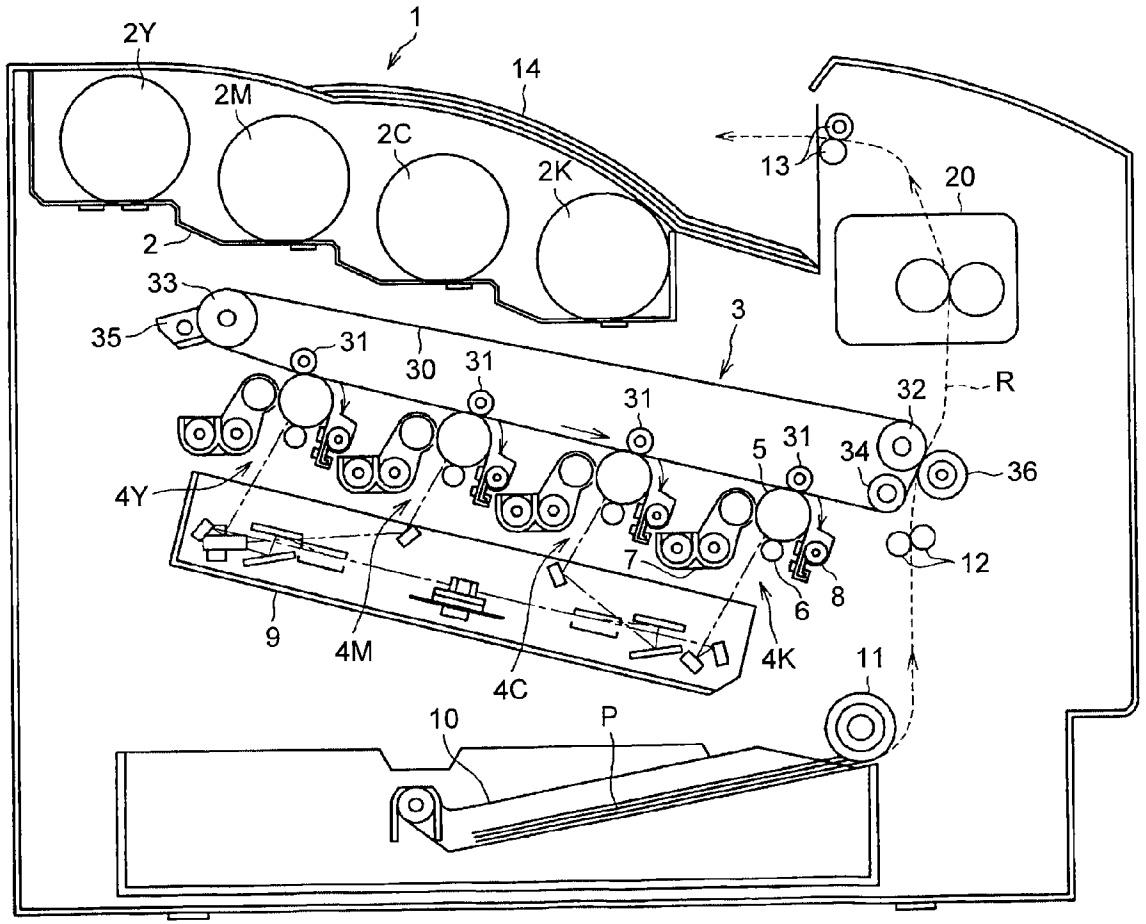
FIG. 1 is a schematic block diagram illustrating one embodiment of an image forming apparatus according to the present invention.

The present inventors have discovered that lowering of fixing quality is related to a deviation between the starting timing of a turning-on/off cycle of a heat source and a passage timing of a recording medium passing through a nip portion, as a result of searching for a reason of lowering the fixing quality in the continuous image-forming job.

That is, from an aspect of the energy saving purposes and image quality, it is ideal that the temperature of a part of the fixing member corresponding to the nip portion is maintained at a constant target temperature (fixing temperature), while this part is in contact with a sheet of paper, during a time period in which a recording medium (the paper) conveyed to the nip portion passes through the nip portion. At this time, the temperature of the fixing member decreases as much as possible, during a time period since the sheet of paper has passed through the nip portion until the next sheet of paper is conveyed to the nip portion. To approach this ideal state, it is effective to set a short control cycle of a turning-on/off cycle of a heat source as much as possible, to operate/stop the heat source with high frequency, and to enhance the temperature conformance between a target temperature and the temperature of a fixing member. At this time, if the heat source is operated/stopped with high frequency, a problem is that the heat source is degraded at an early stage. For example, when the heat source is a halogen heater, if it turns on/off with high frequency, the temperature of an internal filament does not sufficiently increase, and tungsten progressively evaporates, thereby degrading the filament at an early stage. If the heat source is operated/stopped with high frequency, a flicker (flicking of lighting equipment, such as fluorescent light) occurs in another electronic goods on the same power supply line as that of the image forming apparatus, due to a voltage variation for the power supply of the image forming apparatus. There is a limit on setting the short control cycle of the turning-on-off cycle. Thus, the control cycle duration needs to be set long to some extent.

In consideration of the above problem, the control cycle of the turning-on/off cycle of the heat source is set, from an aspect of degradation suppression in the heat source and prevention of a flicker, in the conventional fixing device. Further, for the case of setting the control cycle, no consideration is made to the relationship between the size (conveying direction length) of sheets of paper to be intermittently conveyed to the nip and the space between the sheets of paper. Thus, for the sheet of paper to be conveyed to the nip portion at a predetermined timing, a deviation occurs between the starting timings of the turning-on/off cycle of the heat source, and this deviation may be superimposed on one after another in the sheets in accordance with the progress of a continuous image-forming job. Then, there occurs a phenomenon to decrease or increase the number of turn-ons of the heat source for subsequent sheets of paper from a particular sheet of paper. For the sheet of paper passing through the nip portion, the number of turn-ons of the heat source is decreased or increased. As a result, even if the temperature of the fixing belt is feedback controlled based on temperature information from the temperature detecting unit, the temperature at the nip portion of the fixing belt is away from a target temperature, thus causing a sheet of paper to have the poor gloss due to insufficient fixing or excessive fixing. Particularly, in the fixing device with the fixing member having low heat capacity, the fixing member is responsive to temperature due to operation/stop of the heat source. For the sheet of paper passing through the nip portion, the number of turn-ons of the heat source may be decreased or increased. In this case, the decrease in the number of turn-ons of the heat source decreases the temperature at the nip portion corresponding to the heat end part or back end part of the sheet of paper, causing occurrence of fixing irregularity. On the other hand, the increase in the number of turn-ons is likely to excessively increase the temperature of the fixing member, because a heating area of the fixing member which is heated upon operation of the heat source passes through the nip portion without being in contact with the sheet of paper.

Hence, from an aspect of a decrease in the fixing quality in the continuous image-forming job and an aspect of preventing the excessive temperature rising for the fixing member, it is important to associate the starting timing of the turning-on/off cycle of the heat source with the passage timing of a recording medium passing through the nip portion (relationship between the conveying direction length of sheets of paper and the space between the sheets). Therefore, the present inventors have invented the present invention based on the above finding.

An embodiment of the present invention will now be described based on the attached drawings. In each illustration for explaining the embodiment of the present invention, those parts or constituent elements having the same functions or forms are identified with the same symbols as much as possible, and will not repeatedly be described again.

Descriptions will now be made to the entire configuration and operations of an image forming apparatus according to an embodiment of the present invention, with reference to FIG. 1.

An image forming apparatus 1 of FIG. 1 is a color laser printer, and has four image forming units 4Y, 4M, 4C, and 4K at the center of the apparatus. The image forming units 4Y, 4M, 4C, and 4K have the same configuration, except that they respectively contain different color developers of yellow (Y), magenta (M), cyan (C), and black (K) corresponding to color separation components of a color image.

Specifically, each of the image forming units 4Y, 4M, 4C, and 4K includes a photosensitive element 5 having a drumlike shape as a latent image carrier, a charging device 6 for electrically charging the surface of the photosensitive element 5, a developing device 7 for supplying a toner onto the surface of the photosensitive element 5, and a cleaning device 8 for cleaning the surface of the photosensitive element 5. In FIG. 1, the reference symbols are given only to the photosensitive element 5, the charging device 6, the developing device 7, and the cleaning device 8 included in the image forming unit 4K for black, but are not given to those in the image forming units 4Y, 4M, and 4C.

An exposing device 9 for exposing the surface of the photosensitive element 5 is provided below the image forming units 4Y, 4M, 4C, and 4K. The exposing device 9 has a light source, a polygon mirror, an f-θ lens, a reflecting mirror, and irradiates a laser beam onto the surface of each photosensitive element 5 based on image data.

A transfer device 3 is provided above each of the image forming units 4Y, 4M, 4C, and 4K. The transfer device 3 includes an intermediate transfer belt 30 as a transfer body, four primary transfer rollers 31 as primary transfer units, a secondary transfer roller 36 as a secondary transfer unit, a secondary transfer backup roller 32, a cleaning backup roller 33, a tension roller 34, and a belt cleaning device 35.

The intermediate transfer belt 30 is an endless-loop belt, and is stretched by the secondary transfer backup roller 32, the cleaning backup roller 33, and the tension roller 34. In this case, the secondary transfer backup roller 32 is rotatively driven, thereby the intermediate transfer belt 30 revolves (rotates) in a direction shown with an arrow in the illustration.

The four primary transfer rollers 31 and the photosensitive elements 5 are arranged in such a manner that the intermediate transfer belt 30 is put therebetween, to form a primary transfer nip. To each of the primary transfer rollers 31, a non-illustrative power supply is connected. A predetermined direct current voltage (DC) and/or an alternating current voltage (AC) are applied to each of the primary transfer rollers 31.

The secondary transfer roller 36 and the secondary transfer backup roller 32 are arranged in such a manner that the intermediate transfer belt 30 is put therebetween, to form a secondary transfer nip. Like the primary transfer roller 31, to the secondary transfer roller 36 also, a non-illustrative power supply is connected. A predetermined direct current voltage (DC) and/or an alternating current (AC) are applied to the secondary transfer roller 36.

The belt cleaning device 35 has a cleaning brush and a cleaning blade that are arranged in contact with the intermediate transfer belt 30. A non-illustrative waste toner transport hose extending from the belt cleaning device 35 is connected to an entrance part of a non-illustrative waste toner container.

A bottle container 2 is provided in the upper part of the printer body. In the bottle container 2, four toner bottles 2Y, 2M, 2C, and 2K containing toners to be supplied are attachable/detachable to/from the container. A non-illustrative supply line is provided between each of the toner bottles 2Y, 2M, 2C, and 2K and the developing device 7. A toner is supplied from the toner bottles 2Y, 2M, 2C and 2K to the developing devices 7 through the supply line.

The printer has, in its lower part, a paper-feeding tray 10 containing a sheet of paper P as a recording medium and a paper-feeding roller 11 for conveying the sheet of paper P from the paper-feeding tray 10. The recording medium includes not only a plain sheet of paper, but also cardboard, a postcard, an envelope, thin paper, coating paper (coat paper or art paper), and tracing paper, an OHP sheet. Though not illustrated, a bypass paper feeding mechanism may also be provided.

The printer body includes a conveying path R for discharging the sheet of paper P from the paper-feeding tray 10 through the secondary transfer nip externally therefrom. In the conveying path R, a pair of registration rollers 12 is arranged on the upstream side of a paper conveying direction with respect to the position of the secondary transfer roller 36. The registration rollers 12 are formed as a conveying unit for conveying the sheet of paper P to the secondary transfer nip.

A fixing device 20 for fixing an unfixed image transferred to the sheet P is arranged on the downstream side of the paper conveying direction with respect to the position of the secondary transfer roller 36. Further, a pair of discharging rollers 13 for discharging the sheet of paper externally therefrom is provided on the downstream side of the paper conveying direction of the conveying path R with respect to the fixing device 20. A discharge tray 14 for storing the discharged sheet from the printer is provided on the upper surface of the printer body.

Descriptions will now be made to the basic operations of the printer according to this embodiment, with reference to FIG. 1.

When an image forming operation is started, each photosensitive element 5 of the image forming units 4Y, 4M, 4C, and 4K is rotatively driven by a non-illustrative driving device in a clockwise direction in the illustration. Then, the surface of each photosensitive element 5 is electrically charged by the charging device 6 to uniformly have predetermined polarity. A laser beam is irradiated from the exposing device 9 onto the electrically charged surface of the photosensitive element 5, to form an electrostatic latent image on the surface of the photosensitive element 5. At this time, image information exposed onto each photosensitive element 5 is single-color image information in which a predetermined full-color image is decomposed into color information of yellow, magenta, cyan, and black. Accordingly, a toner is supplied by the developing device 7 to the electrostatic latent image formed on the photosensitive element 5, thereby visualizing the electrostatic latent image as a toner image.

When the image forming operation is started, the secondary transfer backup roller 32 is rotatively driven in a counter clockwise direction in the illustration, thereby the intermediate transfer belt 30 revolves in a direction shown with the arrow in the illustration. Applied to the primary transfer roller 31 is a constant voltage with polarity opposite to the charged polarity of the toner or a voltage by constant current control. As a result, a transfer field is formed in the primary transfer nip between the primary transfer roller 31 and the photosensitive element 5.

After this, in accordance with the rotation of the photosensitive element 5, when the toner image with the colors on the photosensitive element 5 reaches the primary transfer nip, the toner image on the photosensitive element is sequentially superimposed and transferred one after another on the intermediate transfer belt 30, by the transfer field formed in the primary transfer nip. In this manner, a full-color toner image is carried onto the surface of the intermediate transfer belt 30. The toner remaining on the photosensitive element 5 without being transferred to the intermediate transfer belt 30 is removed therefrom by the cleaning device 8. The electricity on the surface of the photosensitive element 5 is neutralized by a non-illustrative neutralizer, and the surface potential is initialized.

The paper-feeding roller 11 starts to be rotatively driven in the lower part of the image forming apparatus, and the sheet of paper P is sent to the conveying path R from the paper-feeding tray 10. The sheet of paper P sent to the conveying path R is sent to the secondary transfer nip between the secondary transfer roller 36 and the secondary transfer backup roller 32, at a timing measured by the registration rollers 12. At this time, applied to the secondary transfer roller 36 is a transfer voltage with polarity opposite to the toner charged polarity of the toner image on the intermediate transfer belt 30. As a result, a transfer field is formed in the secondary transfer nip.

After this, in accordance with the rotation of the intermediate transfer belt 30, when the toner image on the intermediate transfer belt 30 reaches the secondary transfer nip, the toner image on the intermediate transfer belt 30 is transferred onto the sheet of paper P at once, by the transfer field formed in the above-described secondary transfer nip. The excess toner remaining on the intermediate transfer belt 30 without being transferred onto the sheet of paper P is removed by the belt cleaning device 35, and the removed toner is conveyed and collected into a non-illustrative waste toner container.

The sheet of paper P is conveyed to the fixing device 20, and the toner image on the sheet of paper P is fixed thereonto by the fixing device 20. Then, the sheet of paper P is discharged externally from the apparatus by a discharging roller 13, and stored on a discharge tray 14.

The descriptions have been made to the image forming operation for forming a full-color image on a sheet of paper. Other than that, a single color image may be formed using any one of the four image forming units 4Y, 4M, 4C, and 4K, or a two or three-color image may be formed using two or three of the four image forming units.

Descriptions will now be made to a configuration of the above-described fixing device 20 based on FIG. 2.

Figure 2:
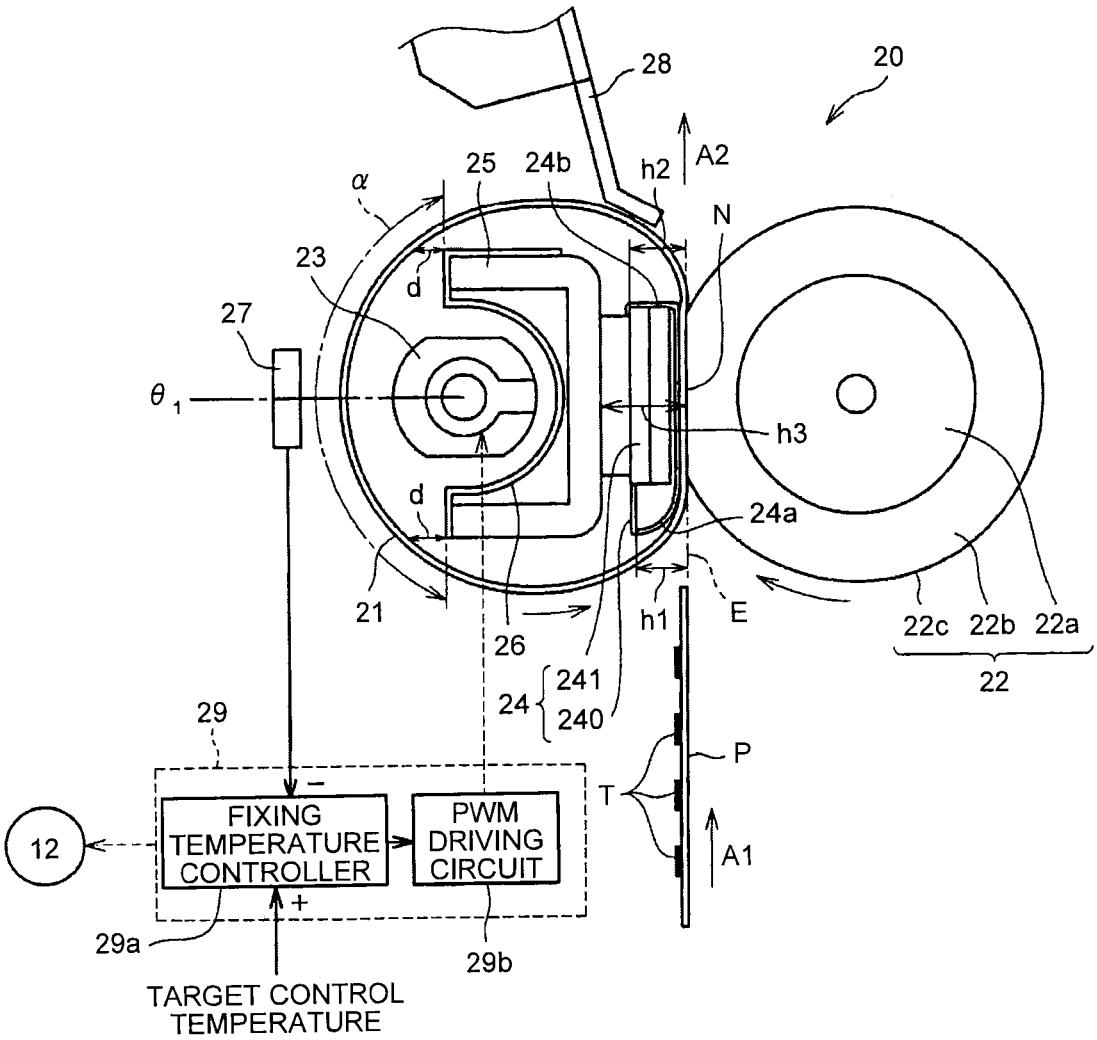
FIG. 2 is a schematic block diagram of a fixing device mounted in the image forming apparatus.

As illustrated in FIG. 2, the fixing device 20 includes a fixing belt 21 as a rotatable fixing member, a pressing roller 22, a halogen heater 23, a nip formation member 24, a stay 25, a reflecting member 26, a temperature sensor 27, a temperature control unit 29, a separating member 28, and a non-illustrative pressing unit. The pressing roller 22 as a pressing member is rotatively arranged in opposition to the fixing belt 21. The halogen heater 23 as a heat source heats the fixing belt 21. The nip formation member 24 is arranged inside the fixing belt 21. The stay 25 as a supporting member supports the nip formation member 24. The reflecting member 26 reflects light reflected from the halogen heater 23 to the fixing belt 21. The temperature sensor 27 as a temperature-detecting unit detects the temperature of the fixing belt 21. The temperature control unit 29 controls the turning-on/off of the halogen heater 23 based on temperature information from the temperature sensor 27. The separating member 28 separates a sheet of paper from the fixing belt 21. The pressing unit presses the pressing roller 22 to the fixing belt 21.

The fixing belt 21 includes a thin and flexible belt member (including a film) with an endless-loop form. More specifically, the fixing belt 21 includes a base material on its inner circumference and a mold release layer on its outer circumference. The base material is formed of a metal material, such as nickel or SUS, or a resin material such as polyimide (PI). The mold release layer is formed of a tetrafluoroethylene-perfluoroalkyl vinyl ether copolymer (PFA) or polytetrafluoroethylene (PTFE). An elastic layer formed of a rubber material, such as silicone rubber, foaming silicone rubber, or fluoro-rubber, may intervene between the base material and the mold release layer.

The pressing roller 22 is formed of core metal 22*a*, an elastic layer 22*b*, and a mold release layer 22*c*. The elastic layer 22*b* is formed of foaming silicone rubber, silicone rubber, or fluoro-rubber, formed on the surface of the core metal 22*a*. The mold release layer 22*c* is formed of PFA or PTFE formed on the surface of the elastic layer 22*b*. The pressing roller 22 is pressed toward the fixing belt 21 by a non-illustrative pressing unit, and is in contact with the nip formation member 24 through the fixing belt 21. In a part where the pressing roller 22 and the fixing belt 21 come into pressure-contact with each other, the elastic layer 22*b* of the pressing roller 22 is pressed, thereby forming a nip portion N with a predetermined width. The pressing roller 22 is configured to be rotatively driven by a non-illustrative driving source, such as a motor, provided in the printer body. When the pressing roller 22 is rotatively driven, its driving force is transmitted to the fixing belt 21 at the nip portion N, and the fixing belt 21 rotates in accordance with the force.

In this embodiment, the pressing roller 22 is a solid roller. However, the pressing roller 22 may be a hollow roller. In this case, a heat source (halogen heater) may be arranged inside the pressing roller 22. If there is no elastic layer, heat capacity will be decreased, thus improving the fixity. However, when pressing an unfixed toner to be fixed, very small concave-convex parts of the surface of the belt are transcribed in the image, resulting in irregularity of gloss in the solid image. To prevent this irregularity, it is preferred to provide an elastic layer with a thickness of 100 μm or greater. If the elastic layer with a thickness of 100 μm or greater is provided, very small concave/convex parts can be absorbed due to elastic deformation of the elastic layer, thus preventing occurrence of the gloss irregularity. The elastic layer 22*b* may be solid rubber. If there is no heat source inside the pressing roller 22, sponge rubber may be used. In this case, sponge rubber is more preferable, because heat of the fixing belt 21 is unlikely absorbed due to its high thermal insulation. The fixing rotation body and the opposed rotation body may be configured simply in contact with each other without being pressed, regardless of being pressure-welded to each other.

The halogen heater 23 has both side ends that are fixed on a side plate (not illustrated) of the fixing device 20. The halogen heater 23 is configured to generate heat under the control of the temperature control unit 29 using power supplied from the power supply provided in the printer body. The turning-on/off is controlled based on a detected result of the surface temperature of the fixing belt 21 by the temperature sensor 27. The temperature of the fixing belt 21 can be set and kept at a desired target temperature (fixing temperature), by the control of the turning-on/off of the halogen heater 23. As a heat source for heating the fixing belt 21, other than the halogen heater, it is possible to use IH heater, a resistance heating element, or a carbon heater.

The temperature control unit 29 includes a fixing temperature controller 29*a*. The fixing temperature controller 29*a* is provided on the electric conduction path from the heat source unit of the printer body to the halogen heater 23, obtains a duty for turning on/off the halogen heater 23 based on temperature information input from the temperature sensor 27, and controls the turning-on/off of the halogen heater 23 through a PWM driving circuit 29*b* based on the obtained duty for a control cycle. In this embodiment, as the fixing temperature controller 29*a*, a PID controller is used. This PID controller variably controls the duty, based on a temperature difference between the temperature information from the temperature sensor 27 and the target control temperature. As the fixing temperature controller 29*a*, other than the PID controller, any temperature controller, which performs various controls, such as PI control, I-PD control, I-P control, and PI-D control, may be used. In this embodiment, the temperature control unit 29 has a function for outputting a control signal to the registration roller 12 (see FIG. 1) and for changing the timing for conveying the sheet of paper P by the registration roller 12. With this, the space between the sheets of paper to be conveyed to the nip portion N is adjusted.

The nip formation member 24 has a base pad 241 and a sliding (low friction) sheet 240 formed on the surface of the base pad 241. The base pad 241 is longitudinally arranged along an axial direction of the fixing belt 21 or an axial direction of the pressing roller 22, and is to determine the form of the nip portion N in accordance with a pressing force of the pressing roller 22. The base pad 241 is fixed and supported by the stay 25. This prevents bending of the nip formation member 24 due to the pressure of the pressing roller 22, and attains a uniform nip width along an axial direction of the pressing roller 22. The stay 25 is preferably formed of a metal material having a high mechanical strength (stainless steel or iron), to satisfy a bending preventing function of the nip formation member 24. The base pad 241 is preferably formed of a material which is kind of hard, to keep the strength. As a material of the base pad 241, a resin (liquid crystal polymer) (LCP), metal, or ceramic may be used.

The base pad 241 is formed of a heat resistance material with a heat proof temperature of 200° C. or higher. In a toner fixing temperature range, the nip formation member 24 is prevented from being deformed due to heat, and the nip portion N is kept in a stable state, thus stabilizing output quality. The base pad 241 may be formed using a general heat-resistant resin, such as polyethersulfone (PES), polyphenylene sulfide (PPS), liquid crystal polymer (LCP), poyether nitrile (PEN), polyamide imide (PAI), polyether ether keton (PEEK).

The sliding sheet 240 may be arranged on the surface of the base pad 241 which is opposed to at least the fixing belt 21. In this arrangement, when the fixing belt 21 rotates, the fixing belt 21 slides on the low friction sheet, thus reducing the driving torque generated at the fixing belt 21 and decreasing the load by the friction onto the fixing belt 21. The configuration may be completed without the sliding sheet.

The above-described reflecting member 26 is arranged between the stay 25 and the halogen heater 23. In this embodiment, the reflecting member 26 is fixed to the stay 25. As a material of the reflecting member 26, aluminum or stainless steel may be used. With the thus-arranged reflecting member 26, light reflected from the halogen heater 23 to the stay 25 is reflected to the fixing belt 21. The quantity of light reflected to the fixing belt 21 can be increased, and the fixing belt 21 can efficiently be heated. Radiant heat from the halogen heater 23 can be suppressed from being transmitted to the stay 25, thus realizing energy saving.

The fixing device 20 according to this embodiment is designed to attain various attempts for realizing further energy saving and for realizing a fast print time.

Specifically, the fixing belt 21 is directly heated in an area except the nip portion N, using the halogen heater 23 (direct-heating method). That is, in this embodiment, because the halogen heater 23 and the reflecting member 26 are arranged in the above manner, a circumferential partial area $\alpha$ is formed for the fixing belt 21 which is formed in relation to the halogen heater 23 without any intervention therebetween. The radiant heat from the halogen heater 23 directly effects on the circumferential partial area $\alpha$ of the fixing belt 21. As a result, at the operating (turning on) of the halogen heater 23, the circumferential partial area $\alpha$ is efficiently and directly heated by the radiant heat from the halogen heater 23, and is increased to a predetermined temperature (hereinafter, the circumferential partial area $\alpha$ of the fixing belt 21 is referred to as a heating area $\alpha$).

The temperature sensor 27 as a temperature detecting unit is configured with a suitable temperature sensor, such as a thermo pile or thermister, and is arranged to detect the temperature of the outer circumferential surface of the fixing belt 21 in a circumferential central position $\theta_1$ of the heating area $\alpha$.

To attain low heat capacity of the fixing belt 21, the fixing belt 21 is made thin and small. Specifically, the base material, the elastic layer, and a mold release layer of the fixing belt 21 have thicknesses of respectively from 20 to 50 μm, 100 to 300 μm, and 10 to 50 μm. The whole thickness is set to be equal to or lower than 1 mm. The diameter of the fixing belt 21 is set from 20 to 40 mm. To attain further low heat capacity, the whole thickness of the fixing belt 21 is preferably equal to or lower than 0.2 mm, and it is more preferably equal to or lower than 0.16 mm. The diameter of the fixing belt 21 is preferably equal to or lower than 30 mm.

In this embodiment, the diameter of the pressing roller 22 is set from 20 to 40 mm. The diameter of the fixing belt 21 may be the same as the diameter of the pressing roller 22. However, the present invention is not limited to this configuration. For example, the diameter of the fixing belt 21 may be smaller than the diameter of the pressing roller 22. In this case, the curvature of the fixing belt 21 in the nip portion N is smaller than that of the pressing roller 22. Thus, the recording medium discharged from the nip portion N can easily be released from the fixing belt 21.

As described above, as a result that the fixing belt 21 is made small in diameter, the space inside the fixing belt 21 is small. However, the stay 25 is bent up at both ends to have a concave form, and the halogen heater 23 is provided inside the concave form, thereby enabling to arrange the stay 25 and the halogen heater 23 in the small space.

To form the stay 25 as large as possible inside the small space, the nip formation member 24 is formed small. Specifically, the width of the paper conveying direction of the base pad 241 is set smaller than the width of the paper conveying direction of the stay 25. Further, in FIG. 2, h1 and h2 are given as heights respectively of an upstream end 24*a* and a downstream end 24*b* in the paper conveying direction of the base pad 241, up to the nip portion N and a virtual extending line E. In addition, h3 is given as a maximum height of the nip formation member 24 excluding the upstream end 24*a* and the downstream end 24*b*, up to the nip portion N and the virtual extending line E. In this case, h1≤h3 and h2≤h3 are given. In this configuration, the upstream end 24*a* and the downstream end 24*b* of the base pad 241 may not intervene between the bent parts of the upstream side and downstream side of the paper conveying direction of the stay 25 and the fixing belt 21. Thus, the bent parts may be arranged adjacent to the inner circumferential surface of the fixing belt 21. This enables to form the stay 25 as large as possible in the limited space of the fixing belt 21, and the strength of the stay 25 can be maintained. As a result, bending of the nip formation member 24 by the pressing roller 22 can be prevented, and the fixity can be improved.

To form the stay 25 as large as possible in the small space, and to maintain the mechanical strength of the stay 25, the left ends of the stay 25 in FIG. 2 are preferably adjacent to the inner circumferential surface of the fixing belt 21 as much as possible. Meanwhile, in the rotation, the fixing belt 21 shakes (disordered movement) to a greater or lesser extent. Thus, if the tip end of the stay 25 is too adjacent to the inner circumferential surface of the fixing belt 21, the fixing belt 21 may be in contact with the tip end of the stay 25. From this aspect, in this embodiment, a distance d of a contact direction of the pressing roller 22 between the tip ends of the stay 25 and the inner circumferential surface of the fixing belt 21 is preferably at least 2.0 mm, and more preferably 3.0 mm or greater.

If the fixing belt 21 hardly shakes due to its sufficient thickness, the above-described distance d can be set to 0.02 mm. Like this embodiment, when the reflecting member 26 is provided on the tip end of a rising part 25*b*, the above-described distance d needs to be set in a manner that the reflecting member 26 is not in contact with the fixing belt 21.

Descriptions will now be made to basic operations of the fixing device 20 according to this embodiment, with reference to FIG. 2.

Once a power switch of the printer body is turned on, power is supplied to the halogen heater 23, and the pressing roller 22 starts to be rotatively driven in a clockwise direction in FIG. 2. Thus, the fixing belt 21 rotates in accordance with the rotation in a counter clockwise direction in FIG. 2, by the friction of the pressing roller 22.

After this, a sheet of paper P is conveyed in the direction of an arrow A1 of FIG. 2 in accordance with the guide of a non-illustrative guide plate, and is sent into the nip portion N formed by the fixing belt 21 and the pressing roller 22 that come into pressure-contact with each other. Note that this sheet of paper P is transmitted to the secondary transfer nip at a predetermined timing by the registration roller 12 illustrated in FIG. 1, and has an unfixed toner image T carried thereon through the above-described image formation process. The sheet of paper P transmitted into the nip portion N is subject to heat by the fixing belt 21 heated by the halogen heater 23 and a pressing force between the fixing belt 21 and the pressing roller 22, while passing through the nip portion N. As a result, the toner image T is fixed on the surface of the sheet of paper P.

The sheet of paper P with the toner image fixed thereon is conveyed from the nip portion N toward the direction with an arrow A2 in FIG. 2. At this time, the tip end of the sheet of paper P is in contact with the tip end of the separating member 28, thereby the sheet of paper P is separated from the fixing belt 21. After this, the separated sheet of paper P is discharged from the discharging roller 13 (see FIG. 1), and is stored on the discharge tray 14 (see FIG. 1).

Figure 3:
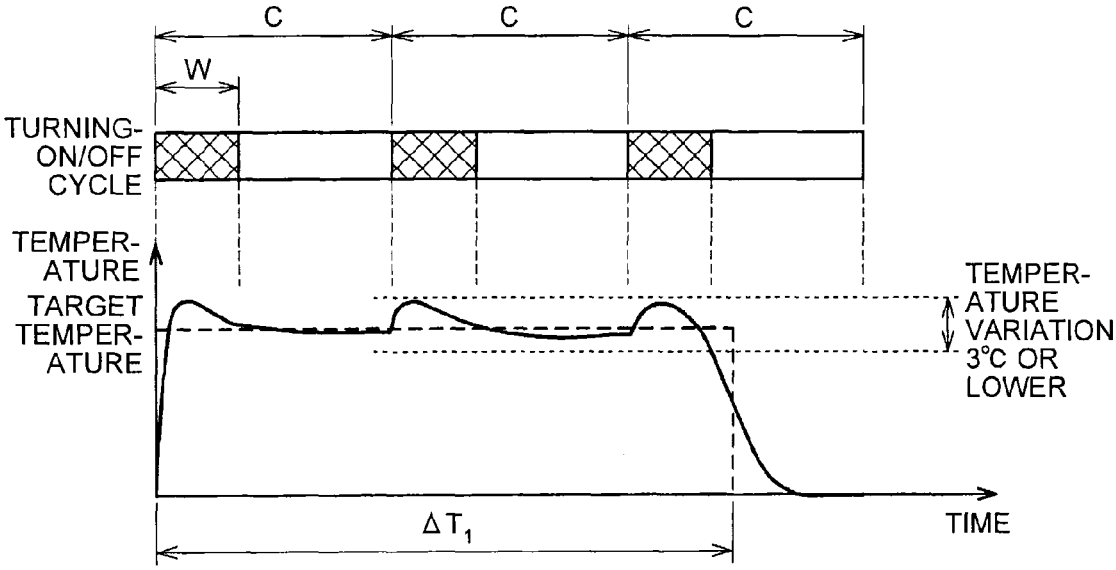
FIG. 3 is a diagram illustrating the relationship between a temperature transition of a fixing belt and a turning-on/off cycle.

FIG. 3 illustrates a transition of the temperature of the fixing belt 21, when the halogen heater 23 turns on and off repeatedly three times in a predetermined control cycle C based on a duty (ratio W/C of a turn-on time period W of the halogen heater 23 per control cycle C), during a time (time period $\Delta T_1$) since the head end of the sheet of paper P reaches the entrance of the nip portion N until the back end thereof has passed through the entrance of the nip portion N. A temperature diagram (solid line) illustrates a transition of the actual temperature of the fixing belt 21, while another temperature diagram (dotted line) illustrates an ideal temperature transition at the entrance of the nip portion N of the fixing belt 21. Ideally, as illustrated in the temperature diagram (dotted line), the temperature at the entrance of the nip portion N of the fixing belt 21 increases to a predetermined target temperature at the starting point (at the point that the head end of the sheet of paper P reaches the entrance of the nip portion N) of the time period $\Delta T_1$. Then, after the target temperature is maintained for the time period $\Delta T_1$, it is preferred that the temperature decreases to a temperature before the temperature increase at the ending point of the time period $\Delta T_1$ (at the point that the back end of the sheet of paper P has passed through the entrance of the nip portion N). The time period $\Delta T_1$ is calculated according to an equation of $\Delta T_1 = L1/V$, where the length of the paper P in the conveying direction is L1 (mm); and the process linear velocity is V (mm/s) as the passage speed of the sheet of paper P passing through the nip portion N.

As illustrated in the temperature diagram (solid line), the temperature of the fixing belt 21 has three peaks, and transits approximately at a constant temperature during the peaks. This reflects the heat and stop in accordance with to turning-on/off of the halogen heater 23 three times. A variation in the temperature of the fixing belt 21 with respect to the target temperature is preferably small as much as possible, from an aspect of the energy saving purposes and image quality, and is preferably equal to or lower than 3° C.

In this embodiment, the temperature of the fixing belt 21 illustrated in the temperature diagram (solid line) of FIG. 3 is in fact a temperature obtained based on the temperature information input from the temperature sensor 27, and is also a temperature detected by the temperature sensor 27 at the circumferential central position $\theta_1$ of the heating area $\alpha$. There is a predetermined time lag since the heating area $\alpha$ of the fixing belt 21 is heated upon the turning-on of the halogen heater 23 until it reaches the entrance of the nip portion N by the rotation of the fixing belt 21. Thus, in this embodiment, the starting timing of the turning-on/off cycle of the halogen heater 23 is advanced by a period of time corresponding to the above-described time lag for the sheet of paper conveyed to the nip portion N. At this time, a time difference since supply of power to the halogen heater 23 until the actual turning on is added to the time lag, if needed. Thus, precisely, the temperature diagram (solid line) of FIG. 3 shifts to the left by the time lag as a whole, while the starting timing (starting time of the first control cycle C of the turning-on/off cycle) of the turning-on/off cycle of the halogen heater 23 for the corresponding sheet of paper P shifts to the left in the same diagram by the time lag, from the starting point (at the point that the head end of the sheet of paper P reaches the entrance of the nip portion N) of the time period $\Delta T_1$. In this embodiment, the time lag (since the heating area $\alpha$ of the fixing belt 21 heated by the tuning on of the halogen heater 23 comes to the entrance of the nip portion N by the rotation of the fixing belt 21) is counted based on the time until which the circumferential central position $\theta_1$ of the heating area $\alpha$ reaches the entrance of the nip portion N. Note that the circumferential head end position of the heating area $\alpha$ may be used as a reference position for counting the time lag. The entrance of the nip portion N as the reference position for counting the above-described time lag may be the upstream end of the nip portion N itself, or may be a point in which the head end of the sheet of paper P to be conveyed to the nip portion N is first in contact with the fixing belt 21. This point is a slightly upstream position from the upstream side of the nip portion N itself.

From the above-described reason, the temperature of the fixing belt 21 illustrated in the temperature diagram (solid line) of FIG. 3 is not the actual temperature at the entrance of the nip portion N1. However, the temperature at the entrance of the nip portion N of the fixing belt 21 shows the same transition as the temperature transition illustrated in the temperature diagram (solid line) of FIG. 3, through the above-described time lag. For the sake of simplicity, with omission of the above-described time lag (supposing that the above-described time lag does not exit), FIG. 3 illustrates the starting timing of the turning-on/off cycle of the sheet of paper P and its corresponding temperature rising timing of the fixing belt 21, in association with the starting point of the time period $\Delta T_1$ (at the point that the head end of the sheet of paper P reaches the entrance of the nip portion N). The above-described time lag does not exist (or unlikely exists) in the fixing device using a method for directly heating the nip portion of the fixing member using a heat source (see Japanese Patent No. 2861280 and Japanese Patent Application Laid-open No.

2011-158558, for example). Therefore, the relationship between the temperature transition at the entrance of the nip portion of the fixing member and the passage timing ($\Delta T_1$) of the sheet passing through the nip portion is in fact the same state as that of FIG. 3. Unless otherwise specifically defined, for the sake of simplicity, descriptions will below be made with omission of the above-described time lag.

In the continuous image-forming job in which images are continuously formed for plural sheets of paper P (continuous printing job), as illustrated in FIG. 3, the first control cycle C of the turning-on/off cycle of the sheet of paper P preferably starts at the point in which the head end of the sheet of paper P reaches the entrance of the nip portion N (starting point of the time period $\Delta T_1$). By setting the starting timing of the turning-on/off cycle in this manner, the number of turn-ons of the halogen heater 23 (turn-on frequency) is the same for all the sheets of paper P, and the temperature transition at the entrance of the nip portion N of the fixing belt 21 may possibly be the same for the all the sheets of paper P. This prevents poor results in the gloss due to insufficient fixing or excessive fixing of the toner, and prevents occurrence of irregularity of gloss due to a temperature drop at the nip portion, resulting in forming a preferably fixed image with preferable quality. In addition, an overheating phenomenon can be avoided. This phenomenon results from the heating area $\alpha$ of the fixing belt 21 passing through the nip portion N without being in contact with the sheet of paper P.

In the continuous image-forming job, to realize a preferable state illustrated in FIG. 3 for all the sheets of paper P, it is necessary to associate the control cycle C of the turning-on/off cycle of the halogen heater 23 with the passage timing of the sheet of paper P passing through the nip portion N. Specifically, the control cycle C and a space L2 between the sheets of paper are set to satisfy the condition of following Equation (1), where the time period since the head end of a sheet of paper P having a predetermined length L1 (mm) in the conveying direction reaches the entrance of the nip portion N until the head end of this sheet of paper P has passed through the entrance of the nip portion N is $\Delta T_1$ (sec); a time period corresponding to the space L2 (mm) between the sheets of paper to be conveyed to the nip portion N is $\Delta T_2$ (sec); the control cycle is C; and n is a positive integer. The time period $\Delta T_1$ and the time period $\Delta T_2$ can be obtained according to equations of $\Delta T_1$=L1/V and $\Delta T_2$=L2/V, respectively, when the process linear velocity is V (mm/sec) as the passage time of the sheet of paper P passing through the nip portion N.

$$\Delta T_1+\Delta T_2=C\times n \text{ (}n\text{ is a positive integer)} \quad (1)$$

Figure 4:
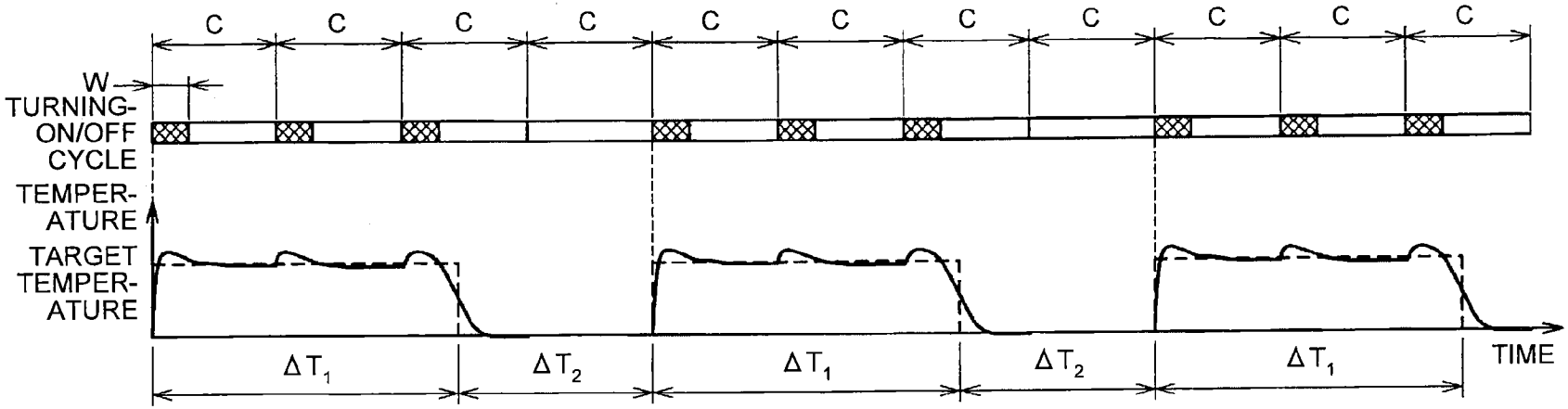
FIG. 4 is a diagram illustrating the relationship between a temperature transition and a turning-on/off cycle of the fixing belt during execution of a continuous image-forming job, and illustrates an embodiment of the present invention.
Figure 5:
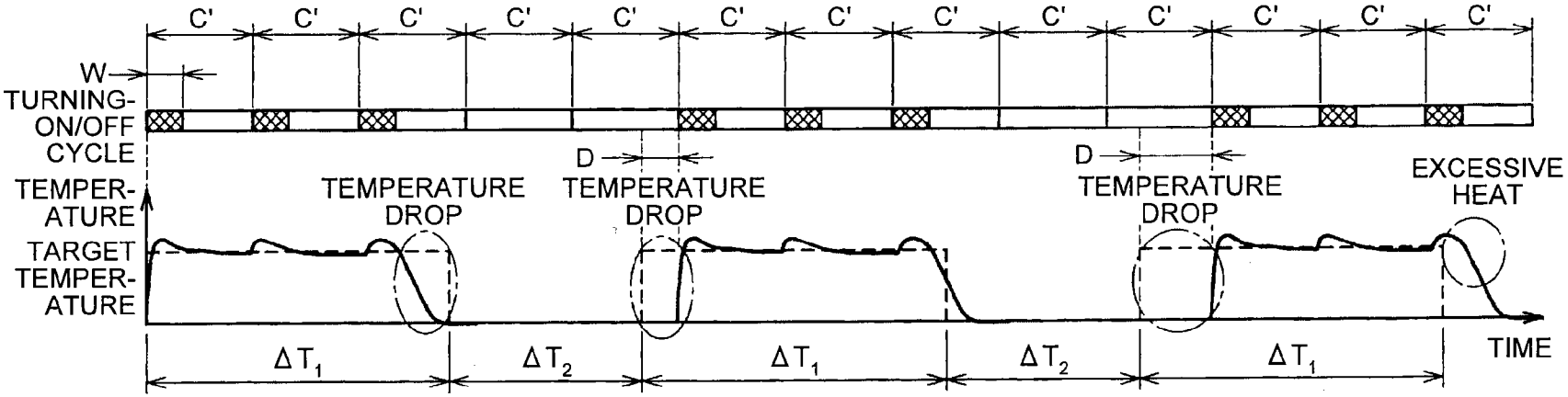
FIG. 5 is a diagram illustrating the relationship between a temperature transition and a turning-on/off cycle of the fixing belt during execution of the continuous image-forming job, and illustrates a comparative example.

FIG. 4 illustrates an embodiment in which the control cycle C of the turning-on/off cycle of the halogen heater 23 is set to satisfy the condition of Equation (1) (for example, when n=4). FIG. 5 illustrates a comparative example in which a control cycle C' is set regardless of ($\Delta T_1+\Delta T_2$). In this embodiment and the comparative example, the length L1 of the sheet of paper P in the conveying direction, the space L2 between the sheets, and the process linear velocity V, the time period $\Delta T_1$, and the time period $\Delta T_2$ are all constant during execution of the continuous image-forming job, and are the same values between the embodiment and the comparative example. Both in the embodiment and the comparative example, the control cycles C and C' of the turning-on/off cycle are set to turn on the halogen heater 23 for three times, for the sheet of paper P to be conveyed to the nip portion N. Both of the control cycles C and C' are constant during execution of the continuous image-forming job. Further, both in the embodiment and the comparative example, the turn-on duties (W/C, W/C') are controlled to be zero for the space L2 (for the time period $\Delta T_2$) between the sheets of paper, by the fixing temperature controller 29*a* of the temperature control unit 29. The turn-on duties (W/C, W/C') for the sheets of paper (for the time period $\Delta T_1$) is in fact variably controlled by the temperature control unit 29, based on temperature information from the temperature sensor 27.

As illustrated in FIG. 5, in the comparative example, the control cycle C' of the turning-on/off cycle is not set in association with the passage timing ($\Delta T_1+\Delta T_2$) of the sheet of paper P passing through the nip portion N, and the timing ($\Delta T_1+\Delta T_2$) is not equal to the integral multiple of the control cycle C'. Thus, a deviation D occurs in the starting timing of the turning-on/off cycle of the halogen heater 23, for the sheet of paper P to be conveyed to the nip portion N at a predetermined timing, in accordance with the progress of the continuous image-forming job. If the deviation D in the starting timing of the turning-on/off cycle is superimposed in each of the sheet of paper P in accordance with the progress of the continuous image-forming job, there occurs a phenomenon to decrease or increase the number of turns-ons of the halogen heater 23 (turn-on frequency), for subsequent sheets of paper from a particular sheet of paper. In the comparative example of FIG. 5, the halogen heater 23 turns on three times both for the first and second sheets of paper P, but turns on only 2.5 times for the third sheet of paper P. At the first stage that the third sheet of paper P passes through the nip portion N, the temperature at the entrance of the nip portion N of the fixing belt 21 drops. Thus, insufficient fixing of the toner occurs at the head end of the corresponding sheet of paper P, and resulting in irregularity of the toner fixing. An area of the fixing belt 21 corresponding to the remaining one-half (0.5) of turn-on of the halogen heater 23 passes through the nip portion N without being in contact with the corresponding sheet of paper P, and its particular amount of heat is not taken away therefrom by the sheet of paper P, resulting in excessive temperature rising. In the comparative example illustrated in FIG. 5, also when the first and second sheets of paper P pass through the nip portion N, the temperature at the entrance of the nip portion N of the fixing belt 21 drops, due to the control cycle C'. The irregularity of toner fixing may possibly occur on the first and second sheets of paper P, regarding the degree of temperature drop.

In contrast, in the embodiment of FIG. 4, the control cycle C of the turning-on/off cycle of the halogen heater 23 is set to satisfy the above condition, for a passage timing ($\Delta T_1+\Delta T_2$) in which the sheet of paper P passes through the nip portion N. Thus, during execution of the continuous image-forming job, the turning-on/off cycle of the halogen heater 23 starts at a point (starting point of $\Delta T_1$) in which the head end of each sheet of paper P reaches the entrance of the nip portion N, for all the sheets of paper P. As a result, the number of turn-ons (turn-on frequency) of the halogen heater 23 is the same for all the sheets of paper P, and the temperature transition at the entrance of the nip portion N of the fixing belt 21 tends to be the same. Therefore, there is no irregularity of toner fixing due to the temperature drop at the nip portion, thus forming a preferably fixed image with preferable quality. In addition, excessive temperature rising can be avoided in an area of the fixing belt 21, which has been heated by the halogen heater 23 and passed through the nip portion N without being in contact with the sheet of paper P.

In relation to the embodiment of FIG. 4, when continuous image formation is performed on the A4 sheets of paper P in a lateral direction (convey direction length L1=210 mm), an example of setting the control cycle C is illustrated in following Table 1, based on the condition of different PPM (sheets/ min) as the number of sheets to be processed per minute, due to different process linear velocities (mm/sec). In the example of setting the control cycle C illustrated in Table 1 satisfies the condition of above-described Equation (1). In Table 1, values of ($\Delta T_1+\Delta T_2$) are rounded off to the closest integer.

TABLE 1

| PPM [sheets/min] | 20 | 30 | 40 | 50 |
|---|---|---|---|---|
| Process linear velocity V [mm/sec] | 90 | 135 | 180 | 225 |
| Conveying direction length L1 [mm] of paper | 210 | 210 | 210 | 210 |
| Space L2 [mm] between sheets | 60 | 60 | 60 | 60 |
| ($\Delta T_1 + \Delta T_2$) [sec] | 3 | 2 | 1.5 | 1.2 |
| n | Control cycle C [msec] | | | |
| 1 | 3000 | 2000 | 1500 | 1200 |
| 2 | 1500 | 1000 | 750 | 600 |
| 3 | 1000 | 667 | 500 | 400 |
| 4 | 750 | 500 | 375 | 300 |
| 5 | 600 | 400 | 300 | 240 |
| 6 | 500 | 333 | 250 | 200 |
| 7 | 429 | 286 | 214 | 171 |
| 8 | 375 | 250 | 188 | 150 |
| 9 | 333 | 222 | 167 | 133 |
| 10 | 300 | 200 | 150 | 120 |

As described above, the control cycle C is preferably short from a point of view of enhancing the temperature conformance with a target temperature. However, a too-short control cycle C results in some disadvantages, such as degradation of the halogen heater 23 or occurrence of a flicker. Thus, the control cycle C needs to be long to some extent. For example, if 600 msec or greater is required as the control cycle C, it is good to select a control cycle C, in which C=750 msec (n=2, PPM=40), C=600 msec (n=2, PPM=50), C=667 msec (n=3, PPM=30), and C=600 msec (n=5 PPM=20).

The timing ($\Delta T_1+\Delta T_2$) is determined based on the PPM, and the PPM may be changed in accordance with the paper size, even with the same printer model. It is preferred that suitable control cycles C are respectively assigned to the PPM values. However, if it is difficult to do so, the actual effect can highly be expected, simply by optimizing the control cycles C for respective high frequent paper sizes, such as A4, A3, and letter size.

In this embodiment of FIG. 4 and the example of setting the control cycle C illustrated in Table 1, the control cycle C of the turning-on/off cycle of the halogen heater 23 is set (changed) to satisfy the condition of Equation (1). However, in another embodiment, the space L2 between sheets of paper may be changed to satisfy the condition of Equation (1), without changing the control cycle C. In this embodiment, in addition to the space L2 between the sheets of paper, the conveying direction length L1 of the sheet of paper P, the process linear velocity V, the time period $\Delta T_1$, the time period $\Delta T_2$, and the control cycle C are all constant during execution of the continuous image-forming job. Table 2 illustrates an example of setting the space L2 between the sheets of paper (C=600 msec). Table 3 illustrates the timing ($\Delta T_1+\Delta T_2$) corresponding to the space L2 between the sheets of paper as illustrated in Table 2, and Table 4 illustrates the PPM. In Table 2, items showing "-" has a condition of disabling the setting of the control cycle C. Those items of Tables 3 and 4 which correspond to these "-" items have a symbol "-".

TABLE 2

| Process linear velocity [mm/sec] | 90 | 135 | 180 | 225 |
|---|---|---|---|---|
| Conveying direction length L1 [mm] of paper | 210 | 210 | 210 | 210 |
| Control cycle [msec] | 600 | 600 | 600 | 600 |
| n | Space L2 [mm] between sheets of paper | | | |
| 1 | — | — | — | — |
| 2 | — | — | 6 | 60 |
| 3 | — | 33 | 114 | 195 |
| 4 | 6 | 114 | 222 | 330 |
| 5 | 60 | 195 | 330 | 465 |
| 6 | 114 | 276 | 438 | 600 |
| 7 | 168 | 357 | 546 | 735 |
| 8 | 222 | 438 | 654 | 870 |
| 9 | 276 | 519 | 762 | 1005 |
| 10 | 330 | 600 | 870 | 1140 |

TABLE 3

| | Process linear velocity [mm/sec] | | | |
|---|---|---|---|---|
| | 90 | 135 | 180 | 225 |
| n | ($\Delta T_1 + \Delta T_2$) [sec] | | | |
| 1 | — | — | — | — |
| 2 | — | — | 1.2 | 1.2 |
| 3 | — | 1.8 | 1.8 | 1.8 |
| 4 | 2.4 | 2.4 | 2.4 | 2.4 |
| 5 | 3.0 | 3.0 | 3.0 | 3.0 |
| 6 | 3.6 | 3.6 | 3.6 | 3.6 |
| 7 | 4.2 | 4.2 | 4.2 | 4.2 |
| 8 | 4.8 | 4.8 | 4.8 | 4.8 |
| 9 | 5.4 | 5.4 | 5.4 | 5.4 |
| 10 | 6.0 | 6.0 | 6.0 | 6.0 |

TABLE 4

| | Process linear velocity [mm/sec] | | | |
|---|---|---|---|---|
| | 90 | 135 | 180 | 225 |
| n | PPM [sheets/min] | | | |
| 1 | — | — | — | — |
| 2 | — | — | 50.0 | 50.0 |
| 3 | — | 33.3 | 33.3 | 33.3 |
| 4 | 25.0 | 25.0 | 25.0 | 25.0 |
| 5 | 20.0 | 20.0 | 20.0 | 20.0 |
| 6 | 16.7 | 16.7 | 16.7 | 16.7 |
| 7 | 14.3 | 14.3 | 14.3 | 14.3 |
| 8 | 12.5 | 12.5 | 12.5 | 12.5 |
| 9 | 11.1 | 11.1 | 11.1 | 11.1 |
| 10 | 10.0 | 10.0 | 10.0 | 10.0 |

In consideration of ($\Delta T_1+\Delta T_2$) illustrated in Table 3 and the PPM illustrated in Table 4, in Table 2, the preferable spaces L2 between the sheets of paper are: L2=60 mm (n=2, $\Delta T_1+\Delta T_2$=1.2, PPM=50.0); L2=114 mm (n=3, $\Delta T_1+\Delta T_2$=1.8, PPM=33.3); L2=114 mm (n=4, $\Delta T_1+\Delta T_2$=2.4, PPM=25.0), L2=60 mm (n=5, $\Delta T_1+\Delta T_2$=3.0, PPM=20.0).

Figure 6:
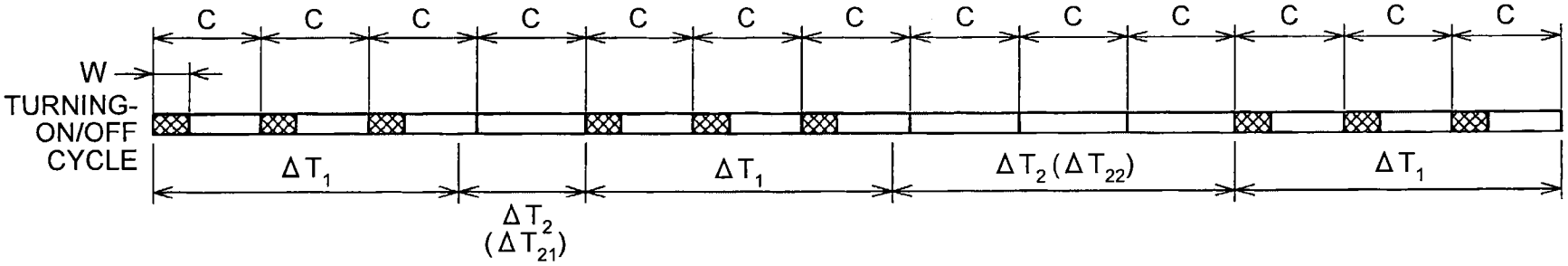
FIG. 6 is a diagram illustrating a turning-on/off cycle during execution of the continuous image-forming job, and illustrates an embodiment for changing a space between sheets of paper.

In the above-described embodiment, the spaces L2 ($\Delta T_2$) between the sheets of paper are constant during execution of the continuous image-forming job. In another embodiment, the spaces L2 ($\Delta T_2$) between the sheets of paper may be changed to satisfy the condition of Equation (1), during execution of the continuous image-forming job, without changing the control cycle C. FIG. 6 illustrates such another embodiment. In the embodiment of FIG. 6, the conveying direction length L1 of the sheets of paper P, the time period $\Delta T_1$, and the control cycle C are all constant during execution of the continuous image-forming job.

As illustrated in FIG. 6, the space L2 (for the time period $\Delta T_2$) between the sheets of paper is changed (that is, different values are given as $\Delta T_1$ and $\Delta T_2$ in the illustration) to start the turning-on/off cycle of the halogen heater 23 starts at a point (starting point of $\Delta T_1$) in which the head end of each sheet of paper P reaches the entrance of the nip N, for all the sheets of paper to be conveyed to the nip portion N. By so doing, the same effect as that of the above-described embodiment can be attained. This control of changing the space L2 (for the time period $\Delta T_2$) between the sheets of paper can be executed, by changing the driving timing of the registration roller 12. This changing is achieved by outputting a control signal from the temperature control unit 29 to the registration roller 12 (see FIG. 1). Note that the registration roller 12 intermittently conveys the sheets of paper P at a predetermined timing.

According to the above-described embodiments, the control cycle C is set without changing the space L2 ($\Delta T_2$) between the sheets of paper, or the space L2 ($\Delta T_2$) between the sheets of paper is set without changing the control cycle C (including a case in which the space L2 between the sheets of paper is changed during execution of the continuous image-forming job), to satisfy the condition of Equation (1), that is, $\Delta T_1+\Delta T_2=C\times n$ (n is a positive integer). However, to satisfy the condition of Equation (1), both of the control cycle C and the space L2 between the sheets of paper may be changed.

In the above-described embodiment, the starting timing of the turning-on/off cycle of the halogen heater 23 coincides with the time point (starting point of $\Delta T_1$) that the head end of each sheet of paper P reaches the entrance of the nip portion N, for all the sheets of paper P, during execution of the continuous image-forming job. However, in consideration of errors or any other matters caused by some mechanical or controlling reasons, the starting time of the turning-on/off cycle of the halogen heater 23 may slightly be deviated from the point (starting point of $\Delta T_1$) that the head end of each sheet of paper P reaches the entrance of the nip portion N, preferably in a direction delayed from the above-described time point. In this case, it is preferably controlled to have a difference equal to or lower than 100 msec between the starting timing of the turning-on/off cycle of the halogen heater 23 for the first sheet of paper P and the starting timing of the turning-on/off cycle of the halogen heater 23 for the last sheet of paper P, for the maximum number of sheets of paper P on which the image forming apparatus 1 can continuously form images, even when the continuous image-forming job is executed. As a result, it is possible to attain preferable quality of toner fixing without irregularity of toner fixing and irregularity of image gloss, on the entire sheets of paper P, during execution of the continuous image-forming job. Note that the maximum number of sheets of paper implies the lower number from the maximum capacity in number of the sheets of paper P in the paper feeding tray 10 of the image forming apparatus 1 and the maximum storage capacity in number of the sheets of paper P after image formation in the discharge tray 14, and is determined based on the model of the image forming apparatus.

Meanwhile, the present invention is applicable to another type of fixing device and an image forming apparatus including another type of fixing device.

Particularly, the present invention is applicable to a fixing device having a belt system (see Japanese Patent Application Laid-open No. 2010-72124 and Japanese Patent Application Laid-open No. 2004-286922) and a fixing device having a heating system (see J Japanese Patent No. 2861280 and Japanese Patent Application Laid-open No. 2011-158558). The fixing device with a belt system has a fixing belt installed between a fixing roller and a heating roller, and causes a pressing roller to be pressure-welded to the fixing roller through the fixing belt. The fixing device having a heating system heats an area of a nip portion of a fixing member, using a heat source.

The present invention is not limited to the fixing device in which the fixing member is formed with a small diameter (low heat capacity) for improving the energy saving. Further, the fixing device of the present invention may be mounted not only on the color laser printer of FIG. 1, but also on a monochrome image forming apparatus, another printer, a copier, a facsimile, and a multifunction machine (MFP) of these. Various changes may be made without departing from the scope of the present invention.

According to the present invention, the number of turn-ons of the heat source is the same for all the recording media, during execution of the continuous image-forming job. Thus, it is possible to prevent a decrease in fixing quality, such as fixing deviation, resulting from poor gloss due to insufficient fixing or excessive fixing or due to a temperature decrease at the nip portion.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A fixing device comprising:

a fixing member that is rotatable and heats a surface of a recording medium on which an unfixed image is carried;

a pressing member that is rotatable and makes pressure-contact with the fixing member to form a nip portion therebetween;

a heat source that heats the fixing member;

a temperature detecting unit that detects a temperature of the fixing member; and a temperature control unit that controls turning-on/off of the heat source in accordance with a predetermined duty for a predetermined control cycle in a turning-on/off cycle, based on temperature information input from the temperature detecting unit, wherein the temperature control unit is configured to, during execution of a continuous image-forming job for continuously forming images on a plurality of recording media, set the control cycle and a space between the recording media to be conveyed to the nip in such a manner that a number of turn-ons of the heat source is the same for all the recording media.

2. The fixing device according to claim 1, wherein the temperature control unit is further configured to control a starting timing of the turning-on/off cycle a difference between a starting timing of the turning-on/off cycle of the heat source for a first recording medium and a starting timing of the turning-on/off cycle of the heat source for a last recording medium to have a difference equal to or lower than 100 msec, even when the continuous image-forming job is performed for a maximum number of recording media on which image formation can continuously be performed by an image forming apparatus having the fixing device.

3. The fixing device according to claim 1, wherein the control cycle and the space between the recording media are set to satisfy a condition of $\Delta T_1+\Delta T_2=C\times n$, where: a time period since a head end of the recording medium reaches an entrance of the nip portion until a back end of the recording medium has passed through the entrance of the nip portion is $\Delta T_1$; a time period corresponding to the space between the recording media is $\Delta T_2$; the control cycle is C; and n is a positive integer.

4. The fixing device according to claim 1, wherein a space between the recording media is changed, during execution of the continuous image-forming job.

5. The fixing device according to claim 1, wherein the fixing member is an endless belt having a thickness equal to or lower than 1 mm.

6. The fixing device according to claim 1, wherein the heat source directly heats the fixing member, in a predetermined area other than the nip portion.

7. The fixing device according to claim 1, wherein the heat source heats the fixing member using radiant heat.

8. The fixing device according to claim 7, wherein the heat source is a halogen heater.

9. An image forming apparatus comprising the fixing device according to claim 1.

* * * * *